United States Patent [19]

Wall

[11] Patent Number: 4,596,948

[45] Date of Patent: Jun. 24, 1986

[54] CONSTANT CURRENT SOURCE FOR INTEGRATED CIRCUITS

[75] Inventor: Llewellyn E. Wall, Irvine, Calif.

[73] Assignee: Irvine Sensors Corporation, Costa Mesa, Calif.

[21] Appl. No.: 661,727

[22] Filed: Oct. 17, 1984

[51] Int. Cl.[4] ..... G05F 3/20

[52] U.S. Cl. ..... 323/312; 330/257

[58] Field of Search ..... 330/257, 277; 307/296 R, 296 A; 323/311, 312, 315, 316, 317

[56] References Cited

U.S. PATENT DOCUMENTS 4,521,739 6/1985 Peterson ..... 330/257

FOREIGN PATENT DOCUMENTS 203305 12/1982 Japan ..... 330/257

*Primary Examiner*—William H. Beha, Jr.

*Attorney, Agent, or Firm*—Thomas J. Plante

[57] ABSTRACT

A stabilized current source for integrated circuit use utilizes a linear ramp voltage across a capacitor to provide the desired current value in a "control" transistor which is in a current mirror relationship with a bias-current-providing transistor. The control and bias-providing transistors are "matched", in the sense that the ratio of the current value in one to the current value in the other remains the same at all times, provided they are subject to the same voltage. The linear ramp voltage across the capacitor causes a constant current to flow through the capacitor and the control transistor. The voltages across the control and bias-providing transistors are retained at the same value. Leakage at one voltage reference terminal of the bias-providing transistor is periodically compensated for by closing a switch between it and the corresponding reference terminal of the control transistor. Thus, the constant current in the control transistor is replicated in the matched bias-providing transistor.

12 Claims, 7 Drawing Figures

CONSTANT CURRENT SOURCE FOR INTEGRATED CIRCUITS

BACKGROUND OF THE INVENTION

This invention relates to integrated circuits, and specifically to the problem of providing stabilized bias current to an amplifier used in an integrated circuit chip.

In electronic environments other than integrated circuits (IC), suitable resistance components are normally used to provide stabilized bias current, i.e., a current source having minimum amplitude variation (ripple). However, resistance components are not suitable for most integrated circuit uses. One reason is that they require more "real estate" than is likely to be available. Also, they tend to have undesired variability of resistance value from component to component; and they tend to vary in resistance value with temperature changes. In IC circuits, desired equivalent resistance values may be obtained using switched capacitor circuitry. Such circuitry may be used, for example, as the feedback resistance of an IC operational amplifier, as shown in U.S. Application Ser. No. 558,009, filed 12/5/83 assigned to the assignee of this application.

In fact, the problem addressed by the present application was encountered in working with the circuitry shown in FIG. 2 of Application Ser. No. 558,009. In that figure, two transistors are shown which provide separate constant bias current sources, respectively, for a differential amplifier and for a source follower output transistor. However, although the present invention was conceived in response to the need for reliable constant bias current sources in the environment of the IC of Application Ser. No. 558,009, it has much broader potential uses.

The switched capacitance technique for providing a resistance-equivalent, which was discussed above, is not suitable for use as the resistance-equivalent in a constant current source. This is true because of the large current transients, or pulsations, that occur during the switching cycle of the switched capacitance network.

SUMMARY OF THE INVENTION

The present invention provides a stabilized bias current by using a linear ramp voltage across a capacitor to provide the desired current value in a "control" transistor which is in a current mirror relationship with a bias-current-providing transistor. The control and bias-providing transistors are "matched", in the sense that the ratio of the current value in one to the current value in the other remains the same at all times, provided they are subject to the same voltage. The linear ramp voltage across the capacitor causes a constant current to flow through the capacitor and the control transistor. The voltages across the control and bias-providing transistors are retained at the same value. Leakage at one voltage reference terminal of the bias-providing transistor is periodically compensated for by closing a switch between it and the corresponding reference terminal of the control transistor. Thus, the constant current in the control transistor is replicated in the matched bias-providing transistor.

DETAILED DESCRIPTION OF SPECIFIC EMBODIMENTS

As stated above, the present invention is useful in providing a constant current source whenever such a source is needed in an IC environment. However, for ease of explanation, the background of Application Ser. No. 558,009 is referenced. That application was primarily concerned with densely-packed "current mode" amplifiers on an IC chip.

Figure 1:
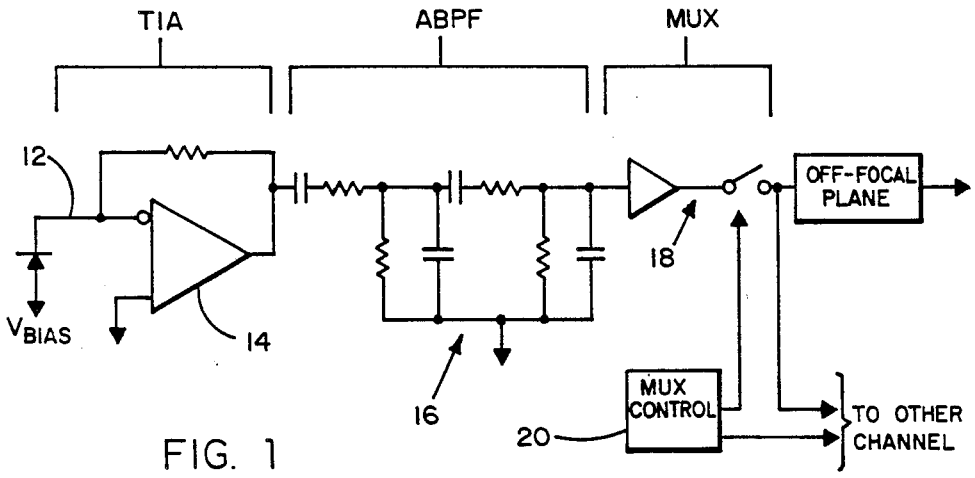
FIG. 1 which is similar to FIG. 1 of Application Ser. No. 558,009, shows an environment in which the present invention might be used.

FIG. 1 illustrates schematically the circuitry that might be included on such a chip. In each of a multiplicity of parallel circuits, a signal 12 is input to a transimpedance amplifier (TIA) 14. The output of each amplifier 14 may be passed through an adaptive bandpass filter 16, and then fed into a multiplexer comprising branches 18 and control circuitry 20. As shown, the remaining circuitry connecting to the multiplexer is external to the chip.

Figure 2:
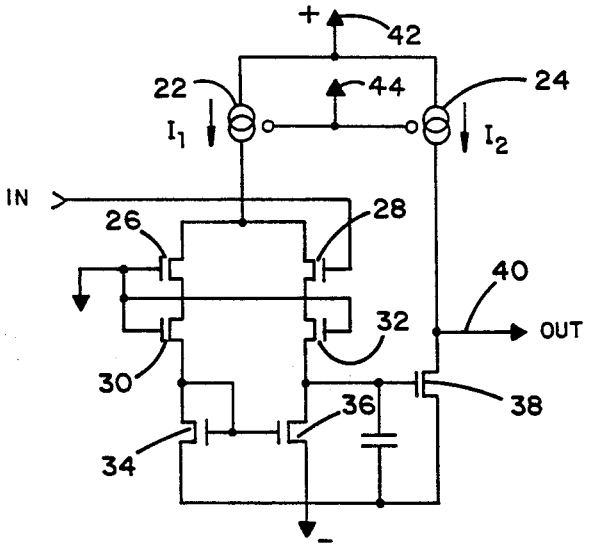
FIG. 2 is a schematic of the trans-impedance amplifier circuit of FIG. 1.

FIG. 2 illustrates an individual on-chip circuit which requires two constant bias current sources. The term "constant current" may require some definition. The permissible variations in current level depend on the particular circuitry. In the circuit of FIG. 2, the maximum permissible variation is quite large, e.g., up to a 3 to 1 ratio of high to low. Obviously, it is desirable to hold the current level in each branch within the minimum variations which are reasonably obtainable.

There are two constant current sources shown in FIG. 2, one indicated by numeral 22, and the other by numeral 24. Constant current source 22 supplies current to the differential amplifier portion of the circuitry, which comprises a differential pair of transistors 26 and 28; a cascode pair of transistors 30 and 32; and a current mirror pair of transistors 34 and 36.

Constant current source 24 supplies current to a source-follower transistor 38, which provides the amplifier output on line 40.

Figure 3:
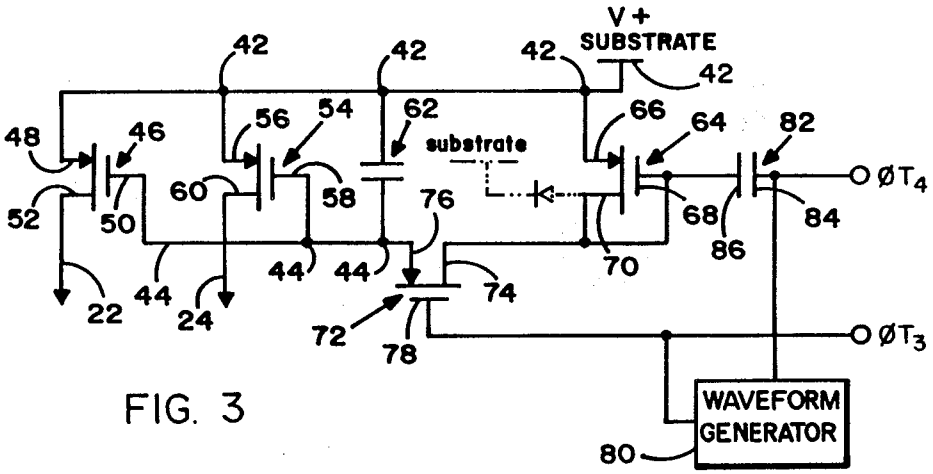
FIG. 3 shows the circuit of the present invention, as it might be used to operate the constant bias current sources required in the circuit of FIG. 2.

Both of the constant current sources 22 and 24 are connected between two reference voltages, one shown as a positive (V+) reference voltage 42, and the other as a reference voltage 44, which is maintained by the circuit shown in FIG. 3. The current supplied by source 24 is substantially larger than that supplied by source 22, but in each instance current fluctuations should be minimized.

FIG. 3 discloses a circuit which efficiently solves the problem of maintaining the constant current required by sources 22 and 24, without encountering the difficulties set forth in the background statement.

The current source 22 in FIG. 3 incorporates a MOSFET (insulated gate field effect) transistor 46, which has its source 48 connected to the V+ reference voltage 42, and its gate 50 connected to the second reference voltage 44. Note that the positive reference voltage is provided by the substrate of the IC chip. The drain 52 of MOSFET 46 is connected to the differential amplifier of FIG. 2. The current flow between the source 48 and drain 52 of MOSFET 46 (and thus the current supplied to the amplifier) is a function of its gate-to-source voltage, which is the voltage difference between the reference voltages 42 and 44. Since 42 has a constant voltage level, the voltage differential across MOSFET 46, and thus the current flow through it, will remain substantially constant if reference voltage 44 is substantially stable.

The same considerations apply to the current source 24, which incorporates a MOSFET (insulated gate field effect) transistor 54, having its source 56 connected to the V+ reference voltage 42, and its gate 58 connected to reference voltage 44. The drain 60 of MOSFET 54 is connected to the source-follower output transistor of FIG. 2. The current flow between the source 56 and drain 60 of MOSFET 54 (and thus the current supplied to the source-follower) is a function of its gate-to-source voltage, which also is the voltage difference between the reference voltages 42 and 44.

A capacitor 62 is connected between the two reference voltage terminals 42 and 44, i.e., parallel to the gate-to-source voltages of the MOSFETS 46 and 54, for the purpose of maintaining the desired voltage across the bias current transistors. In the circuit used as an example in this application, the preferred voltage on capacitor 62 will be in the range of 1–2 volts. Since the charge on capacitor 62 will tend to "leak" over a period of time, thereby reducing the voltage differential which needs to be stabilized, it is necessary to provide means for restoring and maintaining the capacitor's voltage.

The control current, which is mirrored, or replicated, in the bias-providing transistors 46 and 54, is provided by a "matched" control transistor 64, also a MOSFET (insulated gate field effect) transistor, which has its gate-to-source voltage parallel to the gate-to-source voltages of transistors 46 and 54, when switch 72 is closed. Source 66 of control transistor 64 is connected to positive reference terminal 42. Gate 68 and drain 70 of control transistor 64 are interconnected (i.e., the transistor is "diode-connected"). The gate/drain terminal of transistor 64 is intermittently connected to reference terminal 44 through a switch, which at regular intervals is briefly enabled (closed). The switch is preferably a MOSFET (insulated gate field effect) transistor 72, having its drain 74 connected to the gate/drain terminal of control transistor 64, its source 76 connected to "negative" reference terminal 44, and its gate 78 connected to a waveform generator 80, which controls the timing of the enabled, or "on", periods of the switch. The waveform generator 80 is, of course, located elsewhere than on the IC chip.

During the "on" period of MOSFET switch 72, the voltage across control transistor 64 is "transferred" to capacitor 62, thereby restoring loss due to leakage of the capacitor charge.

The matched transistors 46, 54 and 64 are shown as PMOS devices, i.e., P-channel configuration. NMOS (N-channel) transistors may be substituted, provided all three—46, 54 and 64—are NMOS, in order to maintain their matched relationship. Also, bipolar or JFET transistors could be used, but the matched relationship should be ensured. The switch transistor 72 should be a field effect transistor, because of its effective current cut-off when disabled, or open, and zero "offset" when enabled, or closed.

The primary concept for obtaining the desired current mirror action involves creation in control transistor 64 of a stabilized current which will be reflected as a bias current in transistors 46 and 54. This is accomplished by applying a linear ramp voltage from waveform generator 80 at one side of capacitor 82 to control transistor 64. Side 84 of capacitor 82 is connected to the waveform generator; and the other side 86 of capacitor 80 is connected to both gate 68 and drain 70 of control transistor 64.

Figure 4:
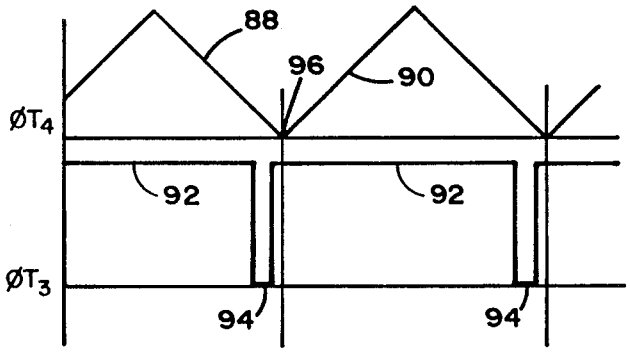
FIG. 4 is a timing diagram exemplifying the ramp and switch-control voltages which might be used in the circuit of FIG. 3.

The waveform applied to side 84 of capacitor 82 has a triangle shape, as shown in FIG. 4. In the present embodiment, the "working" portion of the waveform is the downsloping ramp 88. If desired, the upsloping ramp could be used as the working portion, by reorienting the polarities and connections of the circuit.

The linear ramp 88 represents a changing voltage having a constant rate of change. That linear voltage change on side 84 of capacitor 82 will produce a constant value current, in series, through capacitor 82 and through the source-to-drain channel of control transistor 64. Because this current remains constant, the gate-to-source voltage on transistor 64 remains constant, and the current mirror transistors 46 and 54 provide constant bias currents to their respective circuits. As previously stated, reference terminal 44 is essentially maintained by switch 72 at the same value as the gate (and drain) voltage of the diode-connected control transistor 64.

The current flowing in control transistor 64 caused by downsloping ramp 88 is indicated by the relation: $I \propto Cdv/dt$---. In other words, the amount of current is proportional to the steepness of the ramp slope and the value of the capacitance. Thus, a constant current in transistor 64 is ensured by applying a linear ramp voltage across the capacitor.

The determination of design values begins with the constant current value which needs to be maintained at bias-providing transistors 46 and 54. Because transistors 46, 54 and 64 are "matched", the constant current established in control transistor 64 causes constant current to be maintained in transistors 46 and 54. Matching requires that the voltage-to-current relationship of the three transistors be substantially the same. In other words, the relation of voltage changes to current changes on each of the three transistors should be substantially identical. The specific current values will be different, depending on the selected geometries of the three transistors. Another way of stating this is to say that, as long as each of the three transistors receives equal voltages, the ratios of their amounts of current to one another will be the same.

In MOSFET transistors, current flow is proportional to transistor "width", i.e., the distance from end to end of the source (and drain) along which they "face" one another. (The length is considered to be the distance between the source and drain). Therefore, the relative current values which are desired in the three matched transistors 46, 54 and 64 may be obtained by using transistor widths proportional to those current values, since the same voltage is maintained across all three transistors.

Given the width relationships of the three transistors 46, 54 and 64, and the desired constant current value in current bias transistors 46 and 54, the desired current value in control transistor 64 will be known. This value will be obtained by selecting appropriate values (a) of capacitor 82 and (b) of the slope angle of ramp 88, representing the rate of voltage change on capacitor 82.

As already stated, during the period of the down ramp 88, current flows through capacitor 82 and control transistor 64. During up ramp 90, which is, of course, required to recharge (or reset) capacitor 82, source-to-drain current flow is cut off in control transistor 64. However, it is advantageous to make use of the fact that, during the up ramp period, the drain of transistor 64, in fact, provides a forward-biased diode relationship with the substrate of the IC, as shown in phantom in FIG. 3. This serves as a convenient current return path during the up ramp. Since switch transistor 72 is disabled during the up ramp, the changing voltage during the up ramp does not affect the charge on capacitor 62.

The steepness of up ramp 90 can be varied without affecting operation of the current-bias-providing circuitry. However, the up ramp should not be too steep, in order to avoid excessive current. As a practical matter, it is simple and economical to use a triangular shape which is symmetrical, as shown in FIG. 4.

FIG. 4 also shows the shape of the pulses, supplied by waveform generator 80, which control switch transistor 72. During the positive voltage pulses 92, which are present a very large percentage of the cycle time, the positive voltage at gate 78 disables, i.e., prevents current flow in, transistor 72. During the very brief negative pulses 94, transistor 72 is enabled, and current flows between reference terminal 44 and the gate/drain terminal of control transistor 64. This is sufficient to maintain stabilization of the voltage across capacitor 62. Leakage at terminal 44 between successive closings of switch 72 should be no more than a few tenths of one millivolt. The relationship between the current in transistors 46 and 54 and the voltage across capacitor 62 is not a linear relationship, so that tight control is required on the voltage, in order to avoid excessive variations in the current.

Each switch on pulse 94 is preferably timed, as shown, to occur just before completion of the down ramp 88, i.e., near the end of the down ramp, but just before reaching the point 96 at which the up ramp 90 begins. The "transfer" of voltage via switch 72 must occur during the down ramp, which is responsible for maintaining the desired current value. However, the switch on period is near the bottom of the down ramp 88, in order to provide maximum time for "settling" of the circuit to its optimum parameters. In other words, locating the enabled period of switch 72 near the end of the downslope 88 permits any transient effects to fully "settle out".

Because each amplifier circuit has its own current source, i.e., control transistor 64 and capacitor 82, as part of the same integrated circuit (which is one of many such circuits on an IC chip), current stabilization is much more effective than if an external current source were used.

In a sense the present use of a triangular waveform acting through a capacitor to provide a constant current source is a reversal of the usual situation, in which a constant current source and capacitor are used to provide a sawtooth waveform.

Certain design considerations require discussion. The range of values of capacitor 82 would generally be from 1 to 10 picofarads. If its capacitance is too small, parasitic capacitances will unduly affect the amount of current flow. If its capacitance is too large, it will occupy too much space.

The range of values of capacitor 62 should be similar, i.e., generally from 1 to 10 picofarads. There is a capacitance across switch 72, i.e., from gate 78 to the negative side of capacitor 62. At the point when switch 72 is disabled, that capacitance affects slightly the voltage at the negative side of capacitor 62, which in turn has an effect on the current in transistors 46 and 54. Avoidance of this problem is accomplished by making the capacitance of 62 sufficiently larger than the undesired capacitance.

Figure 5:
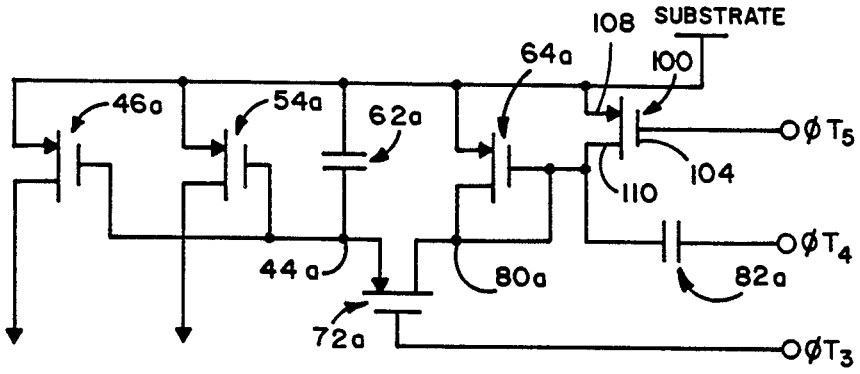
FIG. 5 shows a modified version of the circuit of FIG. 3, which might be preferred if higher voltage levels were used.
Figure 6:
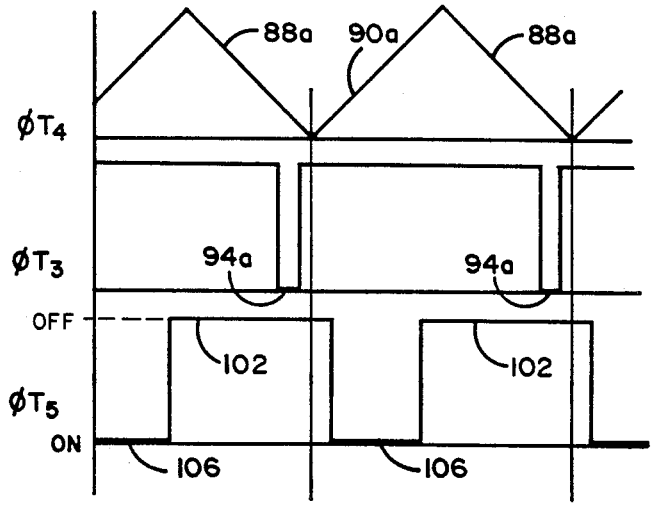
FIG. 6 is a timing diagram related to the circuit of FIG. 5.

FIGS. 5 and 6 show a modified version of the invention, which might be used if lower operating voltages were involved. The circuit of FIG. 5 provides for a different path of current return flow during the up ramp, which does not rely on the substrate of the control transistor. (The numbers applied to the elements in FIG. 5 are the same as those applied to corresponding elements in the previous figures, except that the letter "a" has been added). FIG. 6 shows the timing diagram of the signals from the waveform generator which control timing of the circuit in FIG. 5.

During the period of down ramp **88*a*, source-to-drain current flows through control transistor 64*a* and capacitor 82*a*. This current is mirrored by current-bias-providing transistors 46*a* and 54*a*. Capacitor 62*a* maintains a stabilized voltage on transistors 46*a* and 54*a*. Transistor switch 72*a* is closed to connect terminals 44*a* and 80*a* during the short negative pulses 94*a***, but otherwise is open.

During the period of up ramp **90*a*, current flow in the reverse direction is permitted by a switch transistor 100, whose source-to-drain channel provides a shunt path around control transistor 64*a*. As shown at ØT5, a positive signal 102 at gate 104 of switch 100 holds the switch open during the entire period of down ramp 88*a*, plus short periods before the beginning and after the end of the down ramp. A negative signal 106, during a substantial portion of the period of each up ramp 90*a*, closes switch 100, permitting return current flow, through its source 108 and drain 110, and through capacitor 82*a***. This removes the feature of current return via the transistor substrate.

Figure 7:
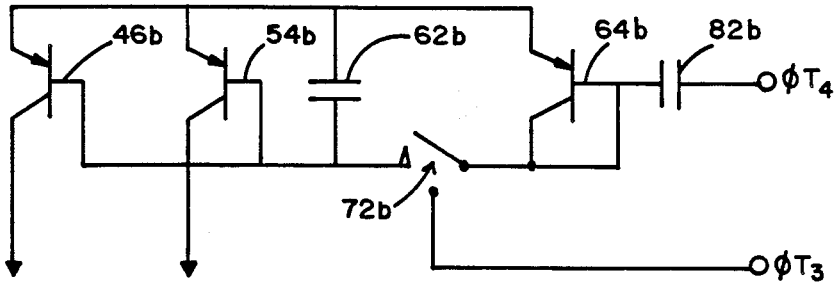
FIG. 7 shows a circuit incorporating the same principles as the circuit of FIG. 3, but substituting bipolar transistors for MOSFET transistors.

FIG. 7 shows a modified version of the invention, in which bipolar transistors are used as the matched transistors, instead of insulated gate transistors. (The numbers applied to the elements in FIG. 7 are the same as those applied to corresponding elements in the previous figures, except that the letter "b" has been added).

During the downramp period, emitter-collector current flows through diode-connected bipolar control transistor **64*b* and through capacitor 82*b*. This current is mirrored by current-bias-providing bipolar transistors 46*b* and 54*b*. Capacitor 62*b* maintains a stabilized voltage on transistors 46*b* and 54*b*. A switch 72*b* is closed to connect terminals 44*b* and 80*b*** during the short negative pulses from the wave-form generator.

As in the circuits incorporating matched MOSFET transistors, the three bipolar transistors 46*b*, 54*b* and 64*b* must be matched in order to provide the desired current mirror relationship. The constant emitter-collector current flow in control transistor 64*b* is caused by the linear voltage ramp applied through capacitor 82*b* to create the base-to-emitter voltage on transistor 64*b*.

In each of the described embodiments, the required constant bias current source is provided by a ramp voltage (linear voltage change) acting on one side of a capacitor (used as a differentiator), the other side of which is clamped to an essentially fixed voltage, which depends on the amount of current flowing through the capacitor. The linearly-changing voltage creates a constant current in a diode-connected control transistor, which constant current maintains the desired voltage across one or more bias-current-providing transistors. In other words, the ramp slope causes the control current, which causes the stabilized voltage. Each integrated circuit has its own control transistor and ramp-driven capacitor. The entire circuit, except for the waveform generator, may be one of numerous such circuits on an IC chip.

From the foregoing description, it will be apparent that the circuitry disclosed in this application will provide the significant functional benefits summarized in the introductory portion of the specification. The following claims are intended not only to cover the specific embodiments disclosed, but also to cover the inventive concepts explained herein with the maximum breadth and comprehensiveness permitted by the prior art.

What is claimed is:

1. An integrated circuit comprising:

a current source comprising a bias-providing transistor for supplying a stabilized current;

a control transistor which is matched to the current source transistor, and which has its current-determining voltage in parallel with the current-determining voltage of the current source transistor;

means for intermittently equalizing the voltages of the control and current source transistors; and means for applying a linear ramp voltage to develop a substantially constant amount of current in the control transistor.

2. The integrated circuit of claim 1 in which the linear ramp voltage applying means includes a capacitor, one side of which is connected to both the voltage and the current branches of the control transistor, and the other side of which is connected to a waveform generator.

3. The integrated circuit of claim 1 which also comprises:

a capacitor connected in parallel with the voltage across the current-bias-providing transistor, between two voltage reference terminals;

a normally open switch between one of those voltage reference terminals and a voltage reference terminal of the control transistor; and means for periodically closing the switch to maintain substantially equalized voltage across the control and current-bias-providing transistors.

4. The integrated circuit of claim 3 wherein the switch is an insulated gate field effect transistor, whose source-to-drain channel is connected between the voltage reference terminals, and whose gate is connected to a wave-form generator.

5. In a circuit having integrated circuitry on a substrate which includes circuitry requiring a substantially constant current bias source, and means external to the integrated circuitry for providing a voltage waveform source, an integrated circuit current source comprising:

first and second voltage reference terminals;

a MOSFET current-source transistor whose source-to-drain current provides the substantially constant bias current, and whose gate-to-source voltage is connected between the first and second voltage reference terminals;

a diode-connected MOSFET control transistor whose gate-to-source voltage is connected between the first reference terminal and a third reference terminal provided by its interconnected gate and drain;

a first capacitor connected between the first and second reference terminals for the purpose of stabilizing the gate-to-source voltage of the current-source transistor;

a normally open switch connected between the second and third reference terminals, and periodically closed to maintain substantial equalization of the voltages on the control and current-source transistors;

a second capacitor having its first side connected to the third voltage reference terminal and to the source-to-drain current of the control transistor, and having its second side connected to the external waveform source; and means for applying a linear ramp voltage from the waveform source to the second side of the second capacitor in such a way as to enable the control transistor and cause in it a constant source-to-drain current flow which is mirrored in the current-source transistor;

the geometries of the control transistor and current-source transistor being such that their respective amounts of current have the same ratio to one another whenever the same voltage is applied to both transistors.

6. The circuit of claim 5 in which both the current-source MOSFET transistor and the control MOSFET transistor are P-channel devices.

7. The circuit of claim 5 in which both the current-source MOSFET transistor and the control MOSFET transistor are N-channel devices.

8. The circuit of claim 5 in which the current return flow when the control transistor is disabled is transmitted via a forward-biased diode effect between the transistor and the substrate of the integrated circuit.

9. The circuit of claim 5 in which the switch is a MOSFET transistor having its source-to-drain current connected between the second and third voltage reference terminals, and its gate connected to the external waveform source.

10. The circuit of claim 9 in which the external waveform source causes the switch MOSFET to be enabled only during a short pulse occurring near the end of the linear ramp voltage waveform which produces constant current flow in the control transistor.

11. The circuit of claim 5 which includes a plurality of parallel current-source transistors, each having the same relationship with the control transistor.

12. The circuit of claim 5 which also comprises:

an additional transistor which provides a current return path during the periods when the control transistor is disabled.

* * * * *